US010042309B2

(12) United States Patent
Nakane

(10) Patent No.: US 10,042,309 B2
(45) Date of Patent: Aug. 7, 2018

(54) PHOTORECEPTOR AND IMAGE FORMING APPARATUS

(71) Applicant: CANON KABUSHIKI KAISHA, Tokyo (JP)

(72) Inventor: Yoshimitsu Nakane, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/715,546

(22) Filed: Sep. 26, 2017

(65) Prior Publication Data

US 2018/0095402 A1 Apr. 5, 2018

(30) Foreign Application Priority Data

Oct. 4, 2016 (JP) ..... 2016-196104

(51) Int. Cl.
*G03G 15/00* (2006.01)

(52) U.S. Cl.
CPC ..... *G03G 15/75* (2013.01)

(58) Field of Classification Search
USPC ..... 399/107, 110, 116, 117, 159, 167
See application file for complete search history.

(56) References Cited

U.S. PATENT DOCUMENTS 5,420,664 A * 5/1995 Miwa ..... F16F 15/126 399/167
5,528,348 A * 6/1996 Miwa ..... F16F 15/1442 399/167
7,184,692 B2 * 2/2007 Kwon ..... G03G 15/757 399/117

FOREIGN PATENT DOCUMENTS

JP 2003-302870 A 10/2003

* cited by examiner

*Primary Examiner* — Hoan Tran
(74) *Attorney, Agent, or Firm* — Fitzpatrick, Cella, Harper & Scinto

(57) ABSTRACT

A photoreceptor includes: a cylindrical support on which a photosensitive layer is formed and to which a predetermined voltage is applicable; and a flange provided in an end portion of the support, the flange including a Helmholtz resonator including a cavity portion and a communication portion allowing the cavity portion and an outside to communicate with each other.

10 Claims, 13 Drawing Sheets

PHOTORECEPTOR AND IMAGE FORMING APPARATUS

BACKGROUND OF THE INVENTION

Field of the Invention

The present invention relates to a photoreceptor on which a photosensitive layer is formed and an image forming apparatus that causes a toner to adhere to the photoreceptor to form an image.

Description of the Related Art

A photoreceptor is applied a predetermined voltage to a surface and is charged, and a toner having a reverse charge is brought to electrostatically adhere to the surface of the photoreceptor by a development device, so that a visual image is formed. When the voltage is applied, a variable electrostatic force acts on the photoreceptor, and the surface of the photoreceptor is vibrated due to the action. When the vibration frequency accords with a specific frequency held by the photoreceptor, the surface of the photoreceptor is largely vibrated by the resonance phenomenon, and a sound is generated from the photoreceptor.

Therefore, the frequency of the voltage to be applied to the photoreceptor is set not to accord with the specific frequency of the photoreceptor. The frequency sometimes accords with the specific frequency of the photoreceptor to improve the quality of the visual image formed on the photoreceptor. In that case, there is a possibility that a sound is generated from the photoreceptor, and thus a measure to arrange a sound absorption material that absorbs the sound generated from the photoreceptor in a propagation path from the photoreceptor to an outside of the image forming apparatus is taken.

Further, as disclosed in Japanese Patent Laid-Open No. 2003-302870, a measure to arrange a damping member inside the photoreceptor to suppress the vibration of the photoreceptor is taken.

However, the cause of the sound generated from the photoreceptor is the specific frequency of the photoreceptor, and thus the specific frequency of the photoreceptor may just be changed. To change the specific frequency of the photoreceptor, there is a measure to make the wall thickness of a cylinder of the photoreceptor large. However, cost of aluminum that is row material of the photoreceptor is high, and thus the measure leads to a substantial increase in cost.

The measure of the sound absorption material described in the conventional technology requires arrangement of the sound absorption material in the entire propagation path from the photoreceptor to an outside of the image forming apparatus. The cost of the sound absorption material is high, and if the sound absorption material is arranged in a wide range, the cost is further increased. In addition, a space to affix the sound absorption material may not be able to be secured in the propagation path. Further, the measure of the sound absorption material cannot substantially decrease a sound having a specific frequency, which is generated from the photoreceptor, because the characteristic of the sound absorption material is a wide frequency range, and a decrease amount of the sound is small.

Further, the measure to arrange the damping member disclosed in Japanese Patent Laid-Open No. 2003-302870 has a high sound decrease effect but the cost may be extremely increased. Especially, in a case of a color image forming apparatus, the photoreceptors are arranged in four places, and the damping members also need to be attached to four places. Therefore, the cost may be further increased.

It is desirable to decrease a sound caused by vibration of a photoreceptor.

SUMMARY OF THE INVENTION

In order to solve the above issue, a photoreceptor according to the present invention includes: a cylindrical support on which a photosensitive layer is formed and to which a predetermined voltage is applicable; and a flange provided in an end portion of the support, the flange including a Helmholtz sound absorbing portion including a cavity portion and a communication portion which allows the cavity portion and an outside to communicate with each other.

Further features of the present invention will become apparent from the following description of exemplary embodiments with reference to the attached drawings.

DESCRIPTION OF THE EMBODIMENTS

Hereinafter, favorable embodiments of the present invention will be exemplarily and specifically described with reference to the drawings. Note that dimensions, materials, shapes, and relative arrangements of configuration components described in the embodiments below should be appropriately changed according to a configuration of a device to which the present invention is applied and various conditions. Therefore, it is not intended to limit the scope of the present invention to the embodiments only, unless otherwise specifically stated.

First Embodiment

A photoreceptor and an image forming apparatus including the photoreceptor according to the present embodiment will be described. First, the image forming apparatus will be described, and then the photoreceptor will be described.

<Configuration of Image Forming Apparatus>

An image forming apparatus to which the present invention can be applied may just have a configuration to form a latent image corresponding to an image information signal on an image bearing member such as a photoreceptor or a dielectric, by an electrophotographic system, an electrostatic recording system, or the like, to develop the latent image by a development device using a two-component developer containing toner particles and carrier particles as main components to form visible images (toner images), to transfer the visible images to a recording material such as a sheet, and to fix the visible images by a fixing device.

First, an overall configuration of an embodiment of an image forming apparatus according to the present invention will be described with reference to FIG. 1. In the present embodiment, a case in which the present invention is applied to a digital copying machine by an electrophotographic system will be described. However, it is needless to say that the present invention can be equally applied to various types of other image forming apparatuses by an electrophotographic system or an electrostatic recording system.

Figure 1:
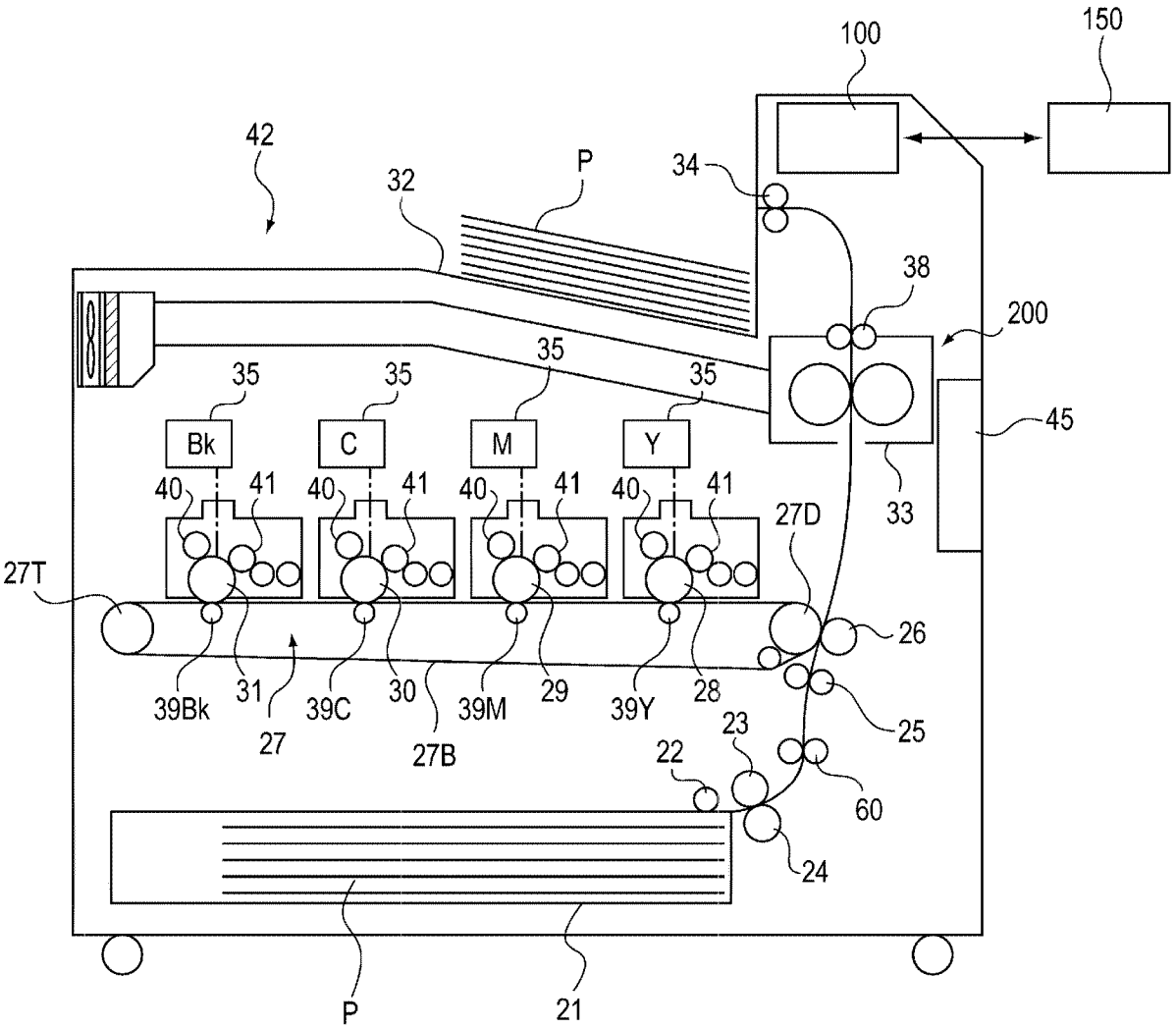
FIG. 1 is a vertical sectional view of a printer of a first embodiment.

The image forming apparatus illustrated in FIG. 1 is a printer 42 by an electrophotographic system. FIG. 1 is a vertical sectional view of the apparatus as viewed from a front side.

The printer 42 can perform an imaging operation according to input image information from an external host device 150 communicatively connected with a control circuit portion (control substrate: CPU) 100, and can form and output a full-color image on a recording material.

The external host device 150 is a computer, an image reader, or the like. The control circuit portion 100 transmits/receives signals to/from the external host device 150. Further, the control circuit portion 100 transmits/receives signals to/from various imaging devices and controls imaging sequence.

FIG. 1 illustrates a sheet feeding cassette 21, a pickup roller 22, a feed roller 23, a retard roller 24, a conveying roller 60, and a pair of resist rollers 25.

FIG. 1 illustrates an intermediate transfer unit 27, a drive roller 27D, and a tension roller 27T. The rollers 27D and 27T stretch an intermediate transfer belt 27B as an endless belt. The drive roller 27D abuts against a secondary transfer roller 26 through the belt 27B. FIG. 1 illustrates primary transfer rollers 39Bk, 39C, 39M, and 39Y. The primary transfer rollers 39Bk, 39C, 39M, and 39Y are pressurized by a spring (not illustrated) toward the belt 27B.

FIG. 1 illustrates photosensitive drums 28 to 31 as photoreceptors (image bearing members) that are held in a main body of the printer 42. The photosensitive drums 28, 29, 30, and 31 are detachably attachable with respect to the main body of the printer 42 in a central axial direction of the photosensitive drums 28 to 31 by releasing an opening/closing member (not illustrated), which also functions as an exterior wall. A laser scanner 35 as an exposure unit exposes a surface of the photosensitive drum (28 to 31) according to image information (image signal), to form an electrostatic latent image on the photosensitive drum. A fixing device 200 as a fixing unit is held in the main body of the printer 42. The fixing device 200 is detachably attachable with respect to the main body of the printer 42 in an upward direction in FIG. 1 by opening a fixing door 45.

A pair of discharge rollers 34 and a discharge tray 32 are respectively installed in upper portions of the main body of the printer 42.

To perform image formation by the printer 42, first, a plurality of sheets P as recording materials is conveyed from the sheet feeding cassette 21 by the pickup roller 22 and is separated to only one sheet by the feed roller 23 and the retard roller 24. After that, the sheet P is conveyed to the pair of resist rollers 25 by a conveying roller 60. Here, the sheet P is stopped once.

To form a predetermined charge on the surfaces of the photosensitive drums 28 to 31, a predetermined voltage (here, about 4 to 5 kV) is applied to charge rollers (charge units) 40, and the charge rollers 40 are applied to the photosensitive drums 28 to 31 by predetermined pressure, to discharge electricity.

The latent images formed on the photosensitive drums 28 to 31 are exposed by the laser scanner 35 and developed with toners by the development devices 41. Toner images formed on the photosensitive drums 28 to 31 are primarily transferred to be layered on the intermediate transfer belt 27B as an endless belt. The toner image primarily transferred on the intermediate transfer belt 27B proceeds to the secondary transfer roller 26, and the sheet P stopped at the pair of resist rollers 25 is re-started in response to the toner image. The toner image is transferred to the re-started sheet P by the secondary transfer roller 26. The sheet P on which the unfixed toner image is borne is heated and pressurized by the fixing device 200, and the unfixed toner image is fixed on the sheet P. The sheet P with the fixed toner image passes through a pair of fixation downstream conveying rollers 38 in a conveying direction of the sheet P and is then discharged onto the discharge tray 32 by the pair of discharge rollers 34.

<Configuration of Photosensitive Drum>

Figure 2:
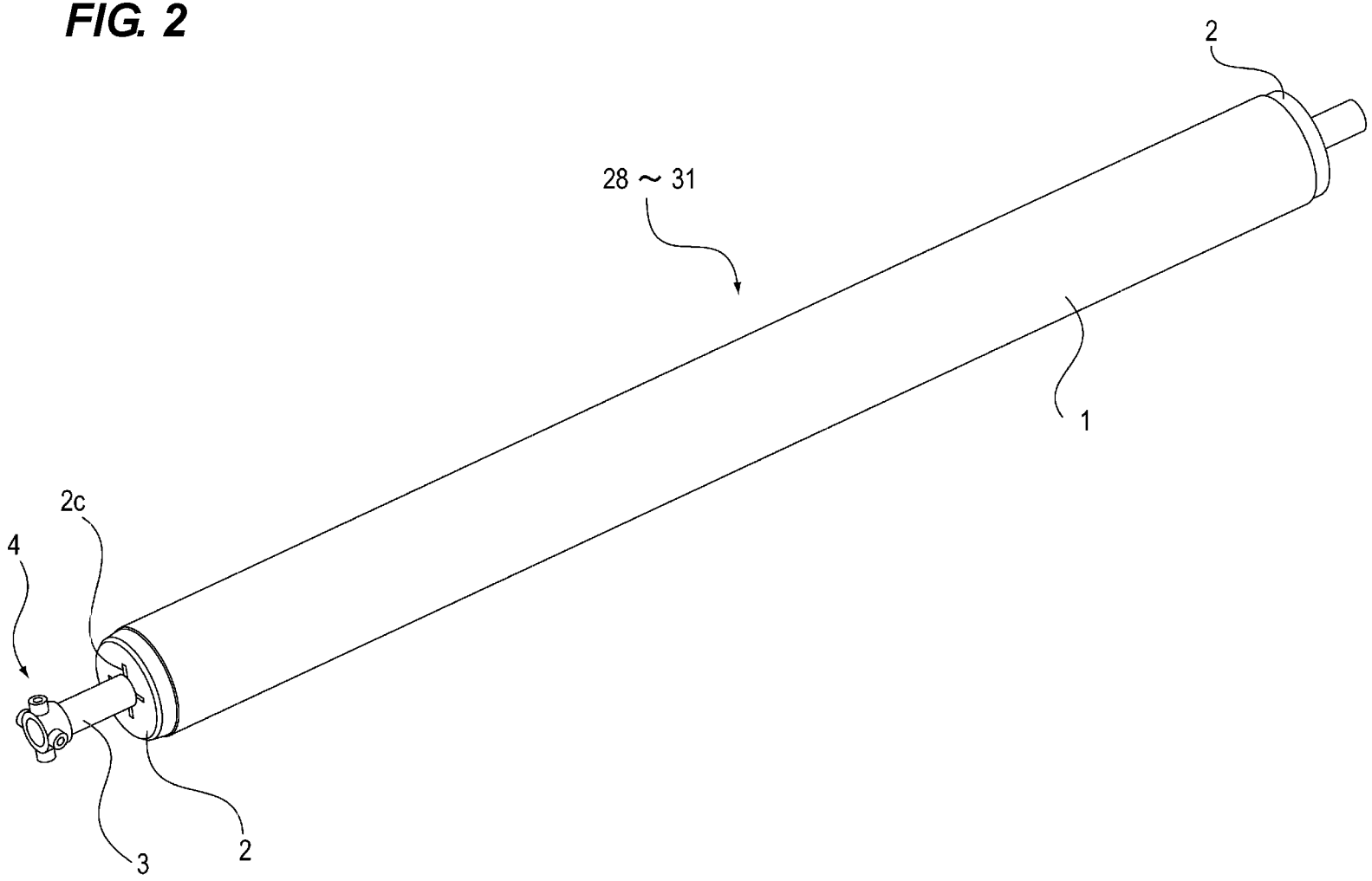
FIG. 2 is a perspective view of a photosensitive drum of the first embodiment.
Figure 3:
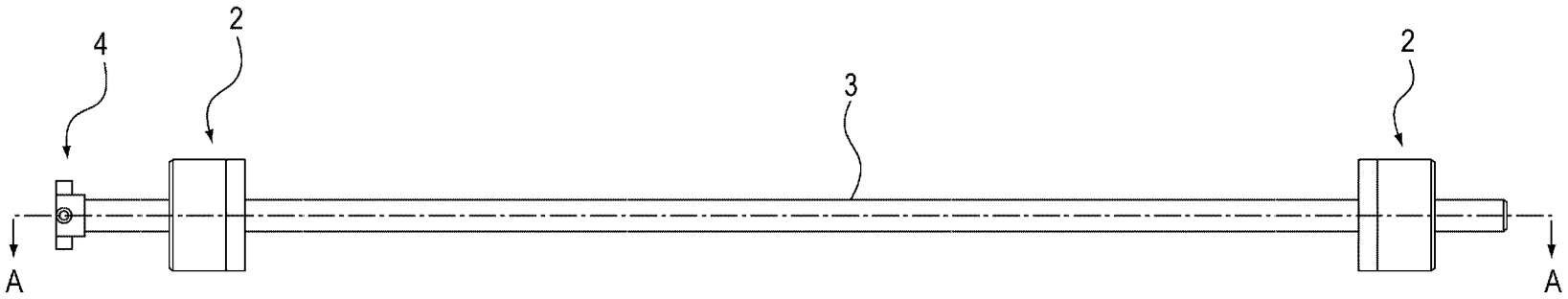
FIG. 3 is a front view of an inside of the photosensitive drum of the first embodiment.
Figure 4:
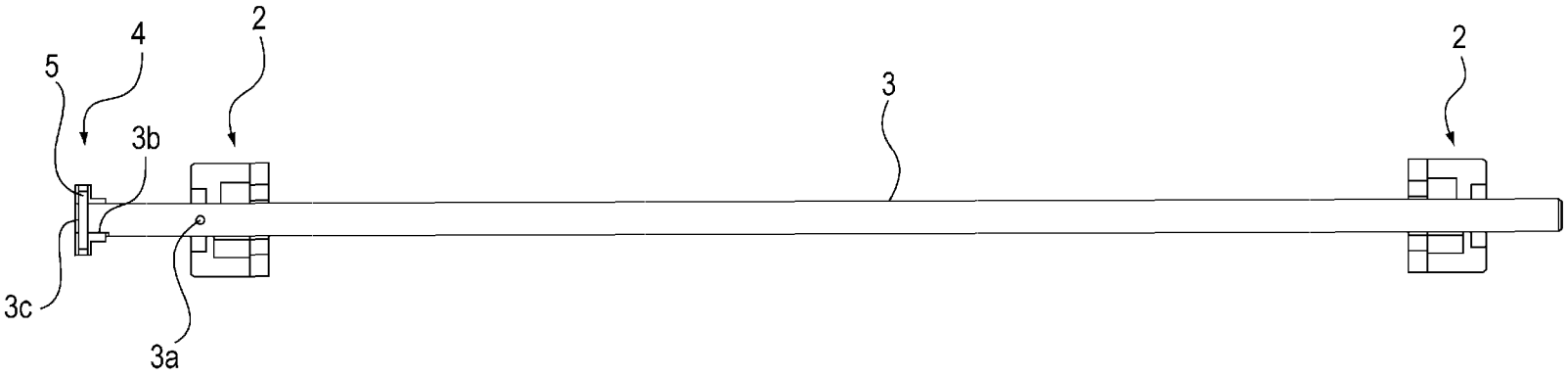
FIG. 4 is a sectional view of an inside of the photosensitive drum of the first embodiment.

Next, the photosensitive drums 28 to 31 used in the first embodiment will be described. FIGS. 2 to 4 are explanatory views illustrating a configuration of a photosensitive drum. FIG. 2 is a perspective view of one of the photosensitive drums 28 to 31. FIG. 3 is a sectional view of one of the photosensitive drums 28 to 31 without a drum element tube 1. FIG. 4 is an A-A sectional view in FIG. 3.

In FIG. 2, the photosensitive drum includes the drum element tube 1 as a cylindrical support, and a drum flange 2. The photosensitive drum further includes a metal shaft 3 and a coupling 4.

In FIG. 2, a photosensitive layer (not illustrated) is formed on the surface of the drum element tube 1, the surface being made of aluminum metal and having a wall thickness of about 1 mm. The drum flange 2 is formed of a resin such as a polyacetal resin (POM) or the like. The drum flange 2 is press-fit into both ends (end portions) of the drum element tube 1 with a predetermined pressure. Further, a cross groove 2*c* formed in a cross manner is formed in an approximate center of the drum flange 2, and the drum flange 2 is fastened with the metal shaft 3 with a metal columnar pin (not illustrated) lying in a circular hole 3*a* made in the metal shaft 3 illustrated in FIG. 4. Further, the metal shaft 3 and the drum flange 2 are press-fit by the predetermined pressure, as illustrated in FIG. 2, thereby to be reliably fastened.

In FIG. 2, a cross-shaped coupling 4 formed of a polyacetal resin (POM) is fixed to one of end portions of the metal shaft 3. The coupling 4 is fastened with the metal shaft 3 with a metal columnar pin 5 lying in a notch portion 3*b* and a circular hole 3*c* provided in the metal shaft 3 as illustrated in FIG. 4. The coupling 4 is transmitted driving through a drum drive motor (not illustrated) and a drive transmission portion such as a gear provided inside the printer 42. The photosensitive drums 28 to 31 are rotated at a predetermined rotational speed as the driving is transmitted through the coupling 4.

<Configuration of Drum Flange 2>

Figure 5:
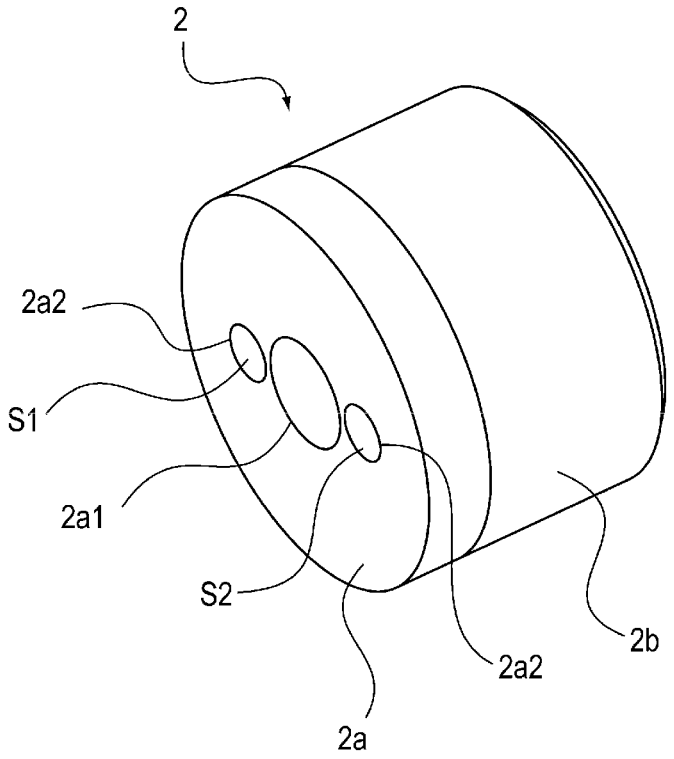
FIG. 5 is a perspective view of a drum flange of the first embodiment.
Figure 6:
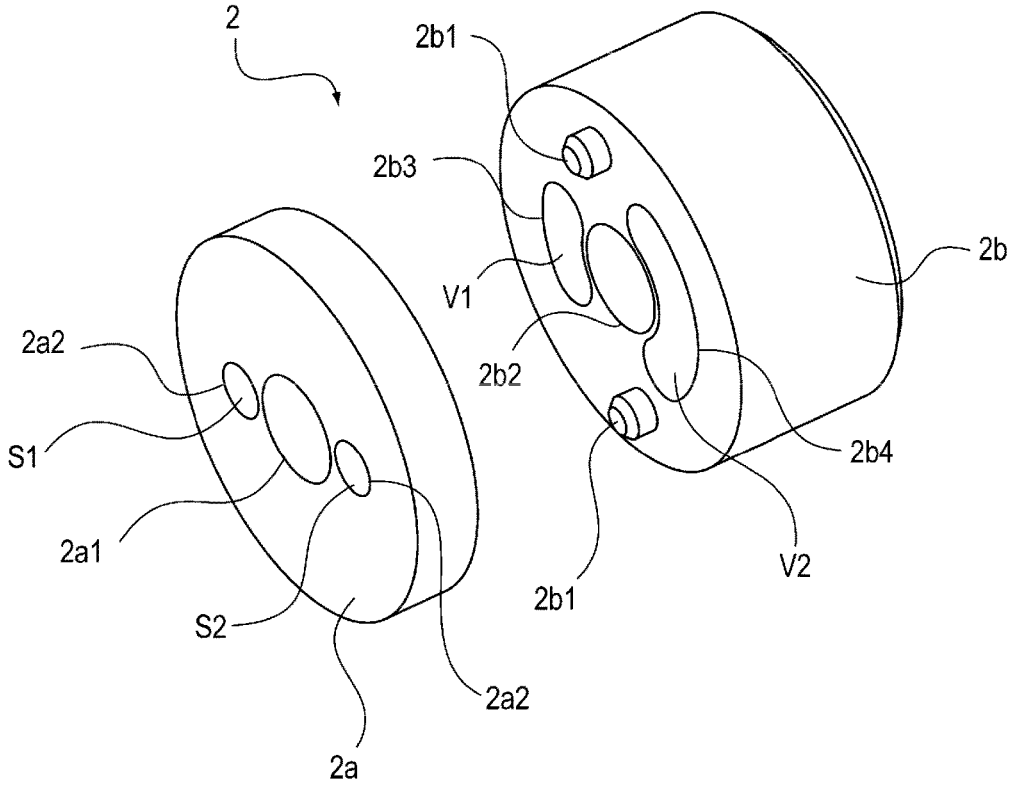
FIG. 6 is an assembly view of the drum flange of the first embodiment.
Figure 7:
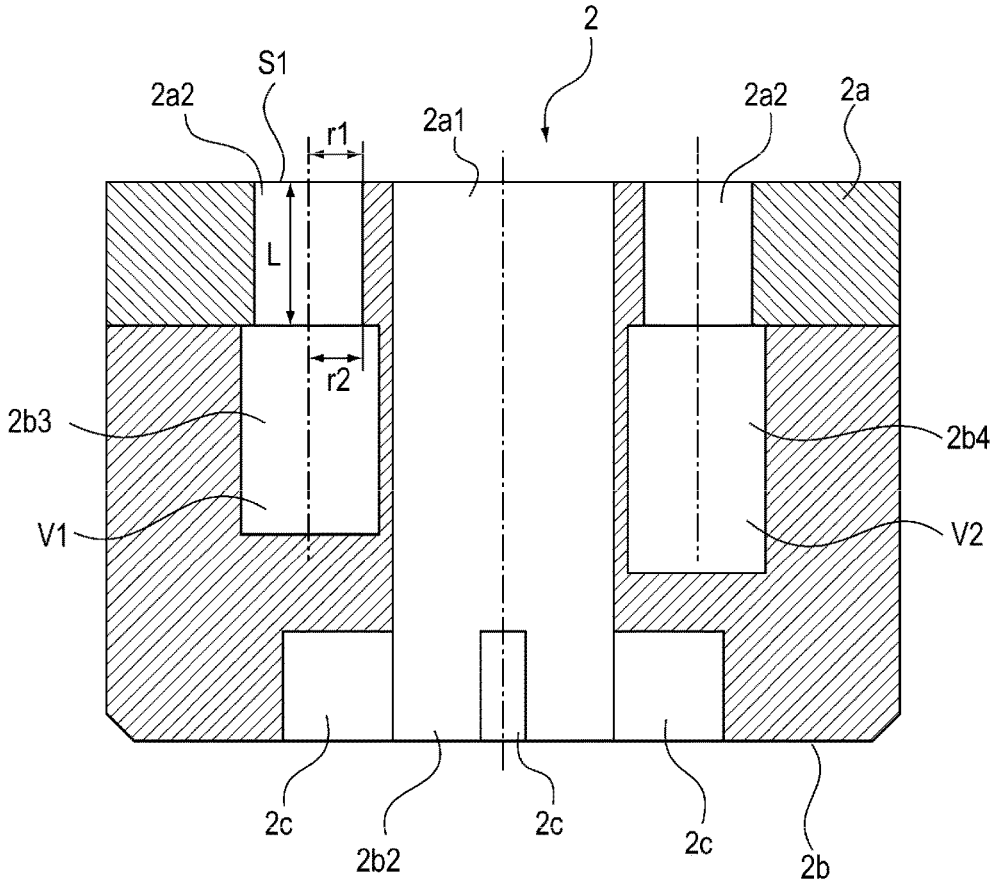
FIG. 7 is a sectional view of the drum flange of the first embodiment.

FIGS. 5 to 7 are explanatory views of the drum flange 2 of the first embodiment. FIG. 5 is a perspective view of the drum flange 2. FIG. 6 is an assembly view of the drum flange 2. FIG. 7 is a sectional view of the drum flange 2.

In FIG. 5, the drum flange 2 includes a plurality of flange portions. Here, the drum flange 2 is provided with separate second flange portion 2*a* and first flange portion 2*b*. The second flange portion 2*a* is provided with a metal shaft hole 2*a*1 through which the metal shaft 3 passes and Helmholtz holes portion 2*a*2. The Helmholtz hole portions 2*a*2 are a plurality of hole portions respectively connected with Helmholtz cavity portions 2*b*3 and 2*b*4 described below and which converts vibration of air generated by a resonance of the Helmholtz cavity portions 2*b*3 and 2*b*4 into heat. The drum flange 2 includes the Helmholtz cavity portions 2*b*3 and 2*b*4, and the Helmholtz hole portions 2*a*2 that allow the Helmholtz cavity portions 2*b*3 and 2*b*4 and an outside to communicate with each other. Then, the Helmholtz cavity portions 2*b*3 and 2*b*4, and the Helmholtz hole portions (communication portions) 2*a*2 configure a Helmholtz sound absorbing portion(Helmholtz resonator). One Helmholtz hole portion (first communication portion) 2*a*2, of the Helmholtz hole portions 2*a*2 as communication portions, allows the Helmholtz cavity portion (first cavity portion) 2*b*3 and the outside to communicate with each other, and the other Helmholtz hole portion 2*a*2 allows the Helmholtz cavity portion (second cavity portion) 2*b*4 and the outside to communicate with each other. Roles of the Helmholtz hole portion 2*a*2 will be described below.

In FIG. 6, the second flange portion 2*a* and the first flange portion 2*b* are fit into each other with accuracy as a cylindrical boss portion 2*b*1 provided in the first flange portion 2*b* enters a hole (not illustrated) having the same diameter with the boss portion 2*b*1 and arranged in the second flange portion 2*a*. In the first flange portion 2*b*, a metal hole 2*b*2 through which the metal shaft 3 passes, and the Helmholtz cavity portions 2*b*3 and 2*b*4 are arranged. The Helmholtz cavity portions 2*b*3 and 2*b*4 arranged in the first flange portion 2*b* are a plurality of voids having different capacities and in which a resonance phenomenon is generated with respect to a frequency of a voltage applied to the drum element tube 1 or a specific frequency of the drum element tube 1. Roles of the Helmholtz cavity portions 2*b*3 and 2*b*4 will be described below. A sound inside the drum element tube 1 enters the Helmholtz hole portions 2*a*2, and resonates inside the Helmholtz cavity portions 2*b*3 and 2*b*4.

Note that, here, a method of measuring the specific frequency of to photosensitive drum including a drum element tube and a drum flange will be described. First, the photosensitive drum including the drum element tube and the drum flange is hung and held at both ends with an elastic body such as rubber. An accelerometer is attached to the drum element tube of the photosensitive drum. After that, a center of the drum element tube is beaten with a hammer, and acceleration with respect to a force applied by the hammer is measured. As a result, a transfer function=the acceleration on the drum element tube/the force of the hammer is measured. A frequency indicating a peak of the transfer function is the specific frequency of the photosensitive drum. The specific frequency of the photosensitive drum is measured in this way.

<Sound Attenuation Principle of Drum Flange 2>

The drum element tube 1 of the photosensitive drum is excited at a predetermined frequency by variation of the voltage applied to the charge roller 40 illustrated in FIG. 1. When an exciting force of the excitation accords with the specific frequency of the photosensitive drum including the drum element tube 1 and the drum flange 2, the drum element tube 1 is severely vibrated in a direction perpendicular to a plane direction the drum element tube 1. As a result, a sound is radiated inside and outside the drum element tube 1. The sound radiated inside the drum element tube 1 is reflected at an inside of the drum element tube 1, and the reflected sound further vibrate the drum element tube 1 and is radiated outside the drum element tube 1. That is, the sound radiated outside the drum element tube 1 is radiated as a composite sound of a direct sound directly radiated outside and an indirect sound that is the sound reflected at the inside of the drum element tube and radiated outside. The present invention attenuates the sound (indirect sound) reflected at the inside the drum element tube to attenuate the composite sound.

In FIG. 7, an inlet radius of the Helmholtz hole portion 2*a*2 is r1, an inlet section area is S1, a length of the Helmholtz hole portion 2*a*2 in an axial direction is L, an outer radius of the Helmholtz hole portion 2*a*2 is r2, and a volume of the inside of the Helmholtz cavity portion 2*b*3 is V1. The sound entering Helmholtz hole portion 2*a*2 causes the inside of the Helmholtz cavity portion 2*b*3 to resonate, and thus the air inside the Helmholtz hole portion 2*a*2 is severely vibrated. The vibration of the air is converted into thermal energy by a friction force between a wall surface of the Helmholtz hole portion 2*a*2 and the air. The sound having entered the Helmholtz hole portion 2*a*2 is attenuated by the action. As a result, the sound inside the drum element tube and the composite sound of the drum element tube 1 are decreased. Note that, here, the sound entering the Helmholtz hole portion 2*a*2 refers to a sound entering the Helmholtz hole portion 2*a*2, of the sound (indirect sound) generated by the vibration of the drum element tube, which is vibrated when the predetermined frequency (exciting force) due to variation of the applied voltage accords with the specific frequency of the photosensitive drum.

Further, the Helmholtz cavity portion 2*b*3 of the first flange portion 2*b* is a space (resonance space) that resonates with the sound having entered the Helmholtz hole portion 2*a*2. Only the existence of the Helmholtz cavity portion 2*b*3 does not enable attenuation of the sound by resonance. As described above, when the inside of the Helmholtz cavity portion 2*b*3 is caused to resonate, the air inside the second flange portion 2*a* connected to the Helmholtz cavity portion 2*b*3 is severely vibrated, and the vibration is converted into the thermal energy by the frictional force between the wall surface of the Helmholtz hole portion 2*a*2 and the air. As a result, the sound is attenuated. That is, the sound, which is generated by the vibration of the drum element tube that is vibrated due to the variation of the applied voltage, resonates by the action of the Helmholtz cavity portion and the Helmholtz hole portion connected to the Helmholtz cavity portion, is converted into the thermal energy, and is attenuated.

As described above, the technology of sound attenuation using the Helmholtz phenomenon is a technology to cause the air to resonate, and convert the sound into heat to attenuate the sound. Note that the resonance effect for the sound entering the Helmholtz hole portion can be obtained when the volume of the Helmholtz cavity portion (void) of the flange cavity portion as a resonance space falls within a ±5% range. To be specific, a volume V1 of the Helmholtz cavity portion 2*b*3 has tolerance of ±5% to exhibit the effect. Therefore, for example, if V1=3.27e-7 ($m^3$), the volume V1 has the tolerance of ±1.6e-8 ($m^3$). Note that the volume of the Helmholtz cavity portion as a resonance space is equal to the capacity in which the resonance phenomenon is generated.

A resonance frequency F of the Helmholtz cavity portion 2b3 can be calculated by the Helmholtz resonance equation and a tube open end correction expression. The length L of the Helmholtz hole portion 2a2 is calculated longer than an actual length due to an influence of the open end correction. The corrected length L is written as effective length L'. First, an expression (1) of the effective length L' is described.

$$L'=L+0.75\times(r1+r2) \quad (1)$$

Next, an expression (2) of the resonance frequency F of the Helmholtz cavity portion 2b3 is described. In the expression (2), C is a sound speed in the air and SQRT is a route.

$$F=C/2\pi\times\mathrm{SQRT}\ (S1/L'\times V1) \quad (2)$$

Calculation is actually made for the size of the drum flange 2 of the present embodiment.

L=5e-3 (m) and the Helmholtz hole portion 2a2 is a circle of radii r1 and r2=2e-3 (m). Therefore, S1 and S2=1.257e-5 ($m^3$).

An effective length L' is calculated by the expression (1).

$$L'=L+0.75\times(r1+r2)=5e\text{-}3+0.75\times(2e\text{-}3+2e\text{-}3)=8.00e\text{-}3\ (m^3)$$

Next, the expression (2) is calculated. The calculation is made where the sound speed C in the air=340 (m/s).

The volume V1 of the Helmholtz cavity portion 2b3 is set to 3.27e-7($m^3$). Therefore, the resonance frequency F of the Helmholtz cavity portion 2b3 is calculated as follows by the expression (2).

$$F=340/2\pi\times\mathrm{SQRT}\ (1.275e\text{-}5/(8.00e\text{-}3\times3.27e\text{-}7))=3751\ (Hz)$$

A volume V2 of the Helmholtz cavity portion 2b4 is set to 6.91e-7 ($m^3$). The resonance frequency F of the Helmholtz cavity portion 2b4 is as follows by the expression (2).

$$F=340/2\pi\times\mathrm{SQRT}\ (1.257e\text{-}5/(8.00e\text{-}3\times6.91e\text{-}7))=2580\ (Hz)$$

Therefore, the present embodiment has a configuration to attenuate (absorb) two different types of sounds (3751 (Hz) and 2580 (Hz)) by the Helmholtz cavity portion 2b3 and the Helmholtz cavity portion 2b4. If the sound inside the drum element tube 1 is 3751 (Hz), the Helmholtz cavity portion 2b3 resonates, and the sound of 3751 (Hz) inside the drum is attenuated by the action of the Helmholtz cavity portion 2b3 and the Helmholtz hole portion 2a2 connected to the Helmholtz cavity portion. At this time, the resonance frequency of the inside of the Helmholtz cavity portion 2b4 is 2580 (Hz) and does not resonate, and thus only the sound of 3751 (Hz) that is the resonance frequency of the Helmholtz cavity portion 2b3 is attenuated.

In the present embodiment, the sound attenuation (sound absorption) is performed for two different types of frequencies. However, the embodiment is not limited thereto. A Helmholtz hole portion (communication portion) maybe further provided in the second flange portion 2a, and a Helmholtz cavity portion connected with the Helmholtz hole portion and having a different volume (capacity) from other Helmholtz cavity portions maybe provided in the first flange portion 2b, if space of the drum flange allows. This enables sound attenuation (sound absorption) for two or more types of different frequencies. The frequency of the charge roller 40 is different when the photosensitive drum including the drum element tube 1 and the drum flange 2 is used in a plurality of the printers 42. However, by use of the present embodiment, sound attenuation of different frequencies (here, two types of frequencies) can be performed common to the photosensitive drums 28 to 31.

According to the present embodiment, a decrease in the sound due to the vibration of the photosensitive drum can be realized with limited cost. Further, the decrease in the sound can be realized with the same photoreceptor, for a plurality of image forming apparatuses having different frequencies of the voltage to be applied to the photosensitive drum.

<Charge Sequence of Charge Roller 40>

Figure 8:
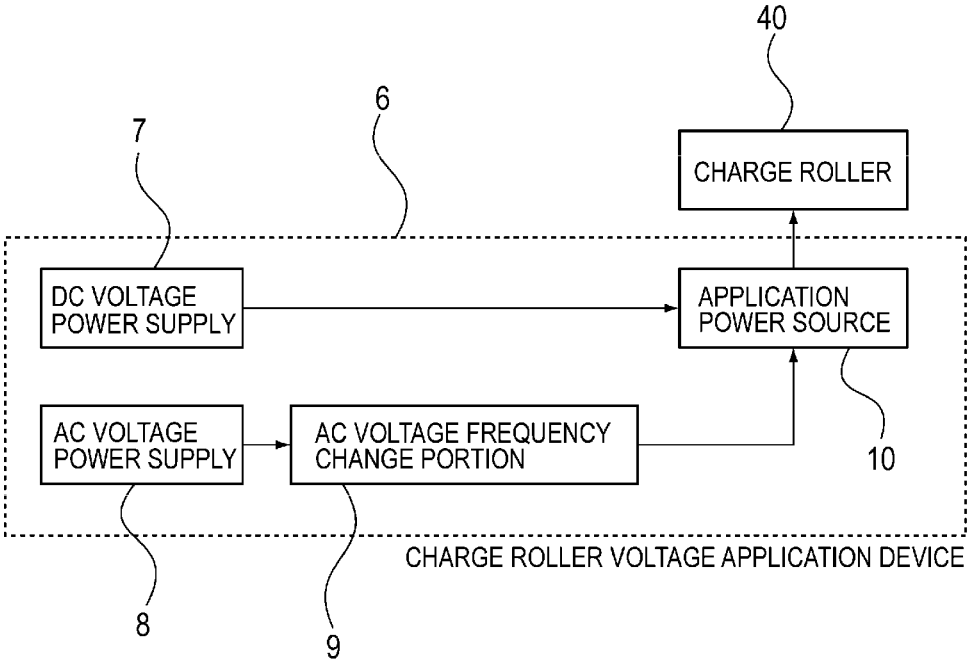
FIG. 8 is an electrical block diagram of a charge roller voltage application device of the first embodiment.
Figure 9:
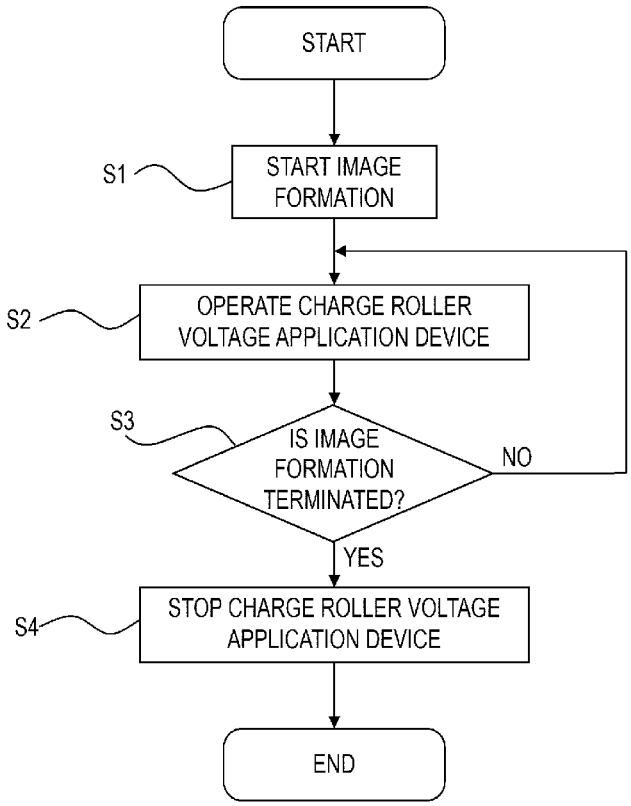
FIG. 9 is a sequence diagram of the charge roller voltage application device of the first embodiment.
Figure 10:
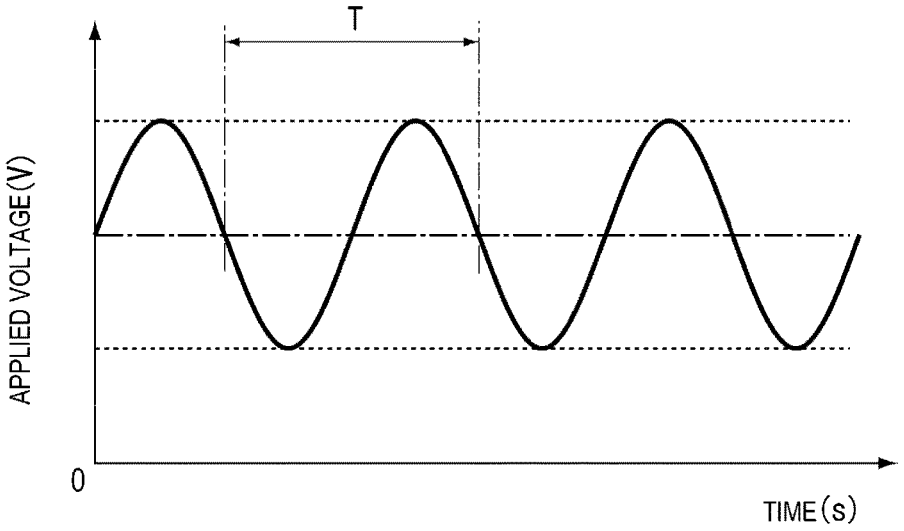
FIG. 10 is a voltage waveform chart of a voltage applied to the charge roller in the first embodiment.

Note that, here, a charge sequence of the charge roller 40 will be described using FIGS. 8 to 10. FIGS. 8 to 10 are explanatory diagrams regarding a method of applying a voltage to the charge roller 40 in the printer 42 of the present embodiment. FIG. 8 is an electrical block diagram of a voltage application device 6 of the charge roller 40. FIG. 9 is a sequence diagram of the voltage application device 6 of the charge roller 40. FIG. 10 is a voltage waveform chart of the voltage applied to the charge roller 40.

In FIG. 8, the voltage application device 6 of the charge roller 40 includes a DC voltage power supply 7 and an AC voltage power supply 8 therein, and the DC voltage power supply 7 and the AC voltage power supply 8 can respectively output a predetermined DC voltage and a predetermined AC voltage. The AC voltage output from the AC voltage power supply 8 is modulated by the AC voltage frequency change portion 9 and converted into an AC voltage having a predetermined frequency. Then, the AC voltage with the modulated frequency and the DC voltage output from the DC voltage power supply 7 are synthesized by the application power source 10 and are applied to the charge roller 40.

In FIG. 9, when image formation of the printer 42 is started (step S1), the voltage application device 6 of the charge roller 40 is operated at the same time (step S2), and a DC-AC synthesized voltage is applied to the charge roller 40. After the image formation is performed by the printer 42, and when the image formation is terminated (step S3), the voltage application device 6 of the charge roller 40 is stopped (step S4). The voltage waveform of the charge roller 40 is a sine wave in which a central voltage is shifted from 0 toward a positive side, as illustrated in FIG. 10, and the voltage having the wave form is applied to the charge roller 40. A period T at this time is a charge frequency of the charge roller 40.

Second Embodiment

Next, a photosensitive drum and an image forming apparatus including the photosensitive drum according to a second embodiment will be described. The second embodiment differs from the first embodiment in the configuration of the drum flange. Configurations of the photosensitive drum and the image forming apparatus, except for a configuration of a drum flange 2, are similar to these of the first embodiment, and thus description is omitted. Hereinafter, a drum flange of the present embodiment will be described.

<Configuration of Drum Flange 2>

Figure 11:
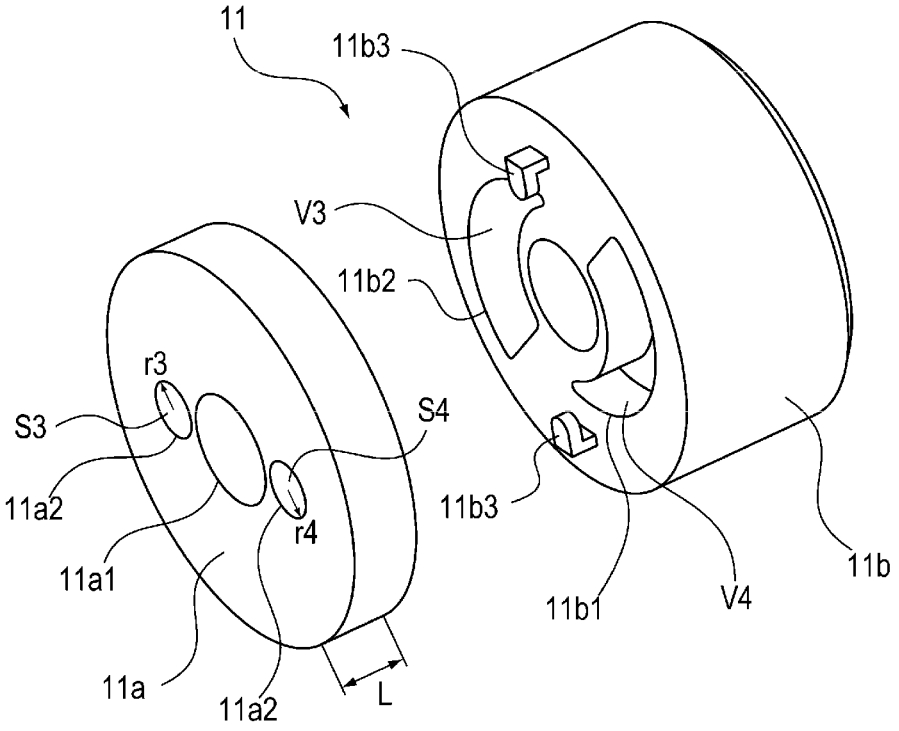
FIG. 11 is a perspective view of a drum flange of a second embodiment.
Figure 12:
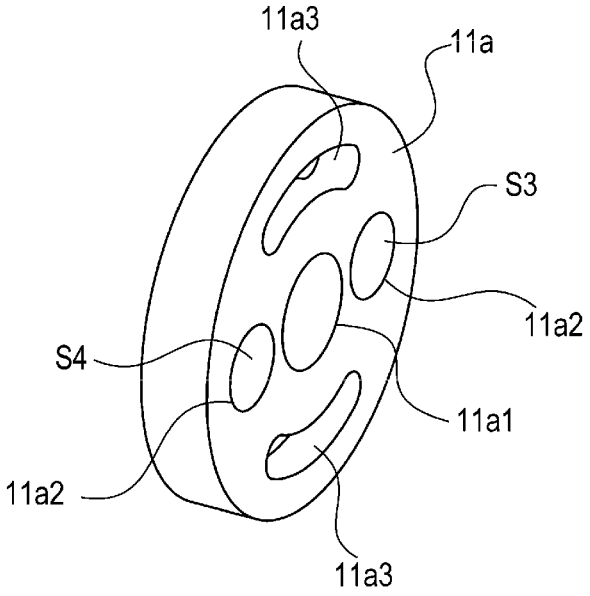
FIG. 12 is a back view of a drum flange cavity portion of the second embodiment.
Figure 13A:
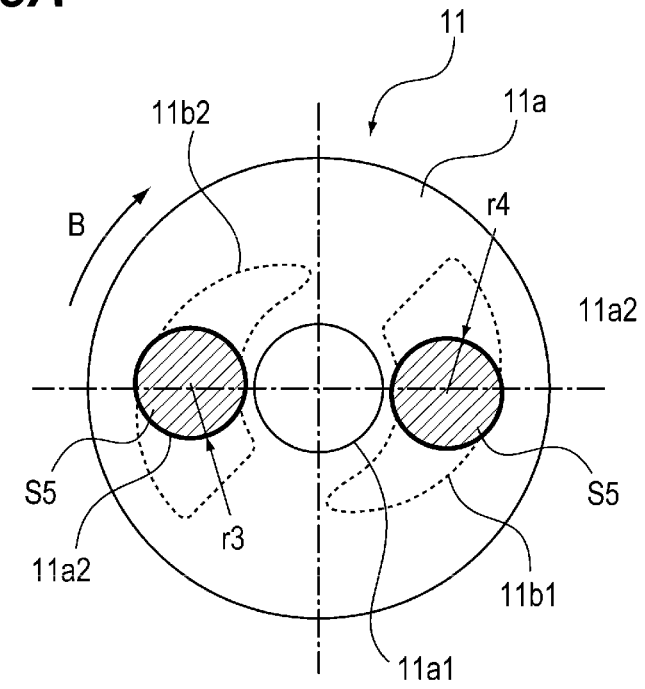
FIGS. 13A and 13B are front views of the drum flange of the second embodiment.
Figure 13B:
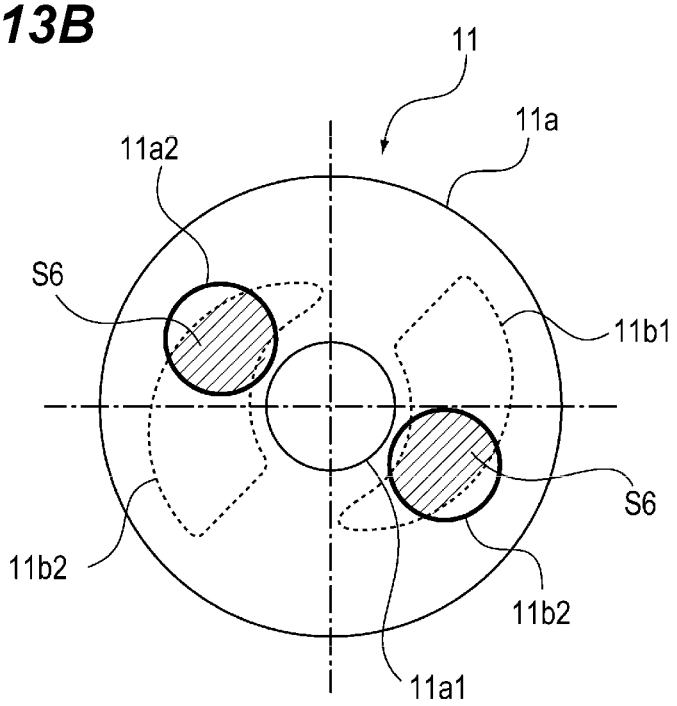

FIGS. 11 to 13A and 13B are explanatory views of a drum flange 11 of photosensitive drums 28 to 31 in a printer 42 in the second embodiment. FIG. 11 is a perspective view of the drum flange 11 in the second embodiment. The drum flange 11 includes a plurality of flange portions. The drum flange 11 is provided with separate second flange portion 11*a* and first flange portion 11*b*. FIG. 12 is a back view of the second flange portion 11*a* of the drum flange 11. FIGS. 13A and 13B are front views of the drum flange 11 of when positions (phases) of the second flange portion 11*a* and the first flange portion 11*b* of the drum flange 11 are changed.

In FIG. 11, the drum flange 11 includes a plurality of flange portions. Here, the drum flange 11 is provided with the separated second flange portion 11*a* and first flange portion 11*b*. The second flange portion 11*a* is provided with a circular hole 11*a*1 through which a metal shaft 3 passes, and Helmholtz hole portions 11*a*2, similarly to the first embodiment. The first flange portion 11*b* is provided with two types of Helmholtz cavity portions 11*b*1 and 11*b*2 having a crescent-shaped cross section and having different voltages.

The plurality of Helmholtz hole portions 11*a*2 and 11*a*2 arranged in the second flange portion 11*a* of the drum flange 11 are a plurality of hole portions respectively connected to the Helmholtz cavity portions 11*b*1 and 11*b*2 described below, and converts vibration of air generated by resonance of the Helmholtz cavity portions 11*b*1 and 11*b*2 into heat. The drum flange 11 includes the Helmholtz cavity portions 11*b*1 and 11*b*2, and the Helmholtz hole portions 11*a*2 that allow the Helmholtz cavity portions 11*b*1 and 11*b*2 and an outside to communicate with each other. Then, the Helmholtz cavity portions 11*b*1 and 11*b*2 and the Helmholtz hole portions 11*a*2 configure a Helmholtz sound absorbing portion.

The Helmholtz cavity portions 11*b*1 and 11*b*2 arranged in the first flange portion 11*b* of the drum flange 11 are a plurality of voids (cavity portions) having different capacities and in which a resonance phenomenon is generated with respect to a frequency of a voltage applied to a drum element tube 1 or a specific frequency of the drum element tube 1. Further, the Helmholtz cavity portions 11*b*1 and 11*b*2 are formed into a shape in which an area and the opening is changed in a rotating direction of the photosensitive drum, the rotating direction being a moving direction to move relative positions of the second flange portion 11*a* and the first flange portion 11*b*, that is, a shape in which the area is changed from a rotation center of the flange 11. Here, as described above, the Helmholtz cavity portions 11*b*1 and 11*b*2 are formed into a crescent shape in cross section.

The second flange portion 11*a* and the first flange portion 11*b* included in the drum flange 11 of the present embodiment are provided in such a manner that the relative positions are movable in the rotating direction of the photosensitive drum, the rotating direction being the moving direction. To be specific, a snap-fit 11*b*3 protruding from a surface is formed on the first flange portion 11*b*. As illustrated in FIG. 12, a groove portion 11*a*3 having a long circular shape, which the snap-fit 11*b*3 enters, is formed in a back surface of the second flange portion 11*a*. When combining the second flange portion 11*a* and the first flange portion 11*b*, the snap-fit 11*b*3 of the first flange portion 11*b* is inserted into, while being deformed, the groove portion 11*a*3 illustrated in FIG. 12. The snap-fit 11*b*3 comes in contact with a side surface of the groove portion 11*a*3 with a predetermined pressure. With the insertion, when the second flange portion 11*a* is rotatably moved and the rotation is stopped, the second flange portion 11*a* is stopped while being held with respect to the first flange portion 11*b* at the position of the stop of the rotation. In FIG. 13A, when the second flange portion 11*a* is moved in the arrow B direction, the Helmholtz hole portion 11*a*2 of the second flange portion 11*a* is changed to the position of FIG. 13B, where the connected area between the Helmholtz cavity portion and the Helmholtz hole portion is smaller than the position of FIG. 13A. With the movement, a frequency at which a sound attenuation effect can be obtained is changed (adjusted).

<Sound Attenuation Principle of Drum Flange 2>

A sound attenuation principle of the drum flange 2 of the second embodiment will be described. In FIG. 11, the thickness of the second flange portion 11*a* is L. Inlet radii of the Helmholtz hole portions 11*a*2 of the second flange portion 11*a* are r3 and r4. Inlet section areas of the Helmholtz hole portion 11*a*2 are S3 and S4 in both FIGS. 13A and 13B, as illustrated in FIG. 12. Outlet section areas of the Helmholtz hole portion 11*a*2 are planes where the Helmholtz hole portions 11*a*2 and the Helmholtz cavity portions 11*b*1 and 11*b*2 intersect with each other and thus are different between the positions of FIGS. 13A and 13B, are S5 at the position of FIG. 13A and are S6 at the position of FIG. 13B. The outlet section areas S5 and S6 of the Helmholtz hole portions 11*a*2 are the shaded portions in FIGS. 13A and 13B. Volumes of the Helmholtz cavity portions 11*b*1 and 11*b*2 are V4 and V3, respectively.

As described in the first embodiment, the length L of the Helmholtz hole portion 11*a*2 is corrected longer than the actual length. The corrected length L is written as effective length L'. An expression (3) of the effective length L' is illustrated.

$$L'=L+0.75\times(r3+r5) \tag{3}$$

Next, an expression (4) of a resonance frequency F is illustrated. In the expression (4), C is a sound speed in the air and SQRT is a square root. r5 and r6 are radii calculated assuming that the outlet section areas S5 and S6 of the Helmholtz hole portion 11*a*2 are circles (not illustrated).

$$F=C/2\pi\times\mathrm{SQRT}\,(S3/(L'\times V3)) \tag{4}$$

In FIG. 13A, the volumes of the Helmholtz cavity portions 11*b*1 and 11*b*2 are set to the volumes V3 and V4 that are different from each other, and thus sound attenuation of different frequencies is possible similarly to the first embodiment. Further, in FIGS. 13A and 13B, the inlet radius of the Helmholtz hole portion 11*a*2 is r3=r4 but the outer radius of the Helmholtz hole portion 11*a*2 is r5>r6. Therefore, the effective length L' becomes longer in FIG. 13A than in FIG. 13B, according to the expression (3). By use of this open end correction principle, a frequency to be attenuated can be changed by changing a phase angle of the second flange portion 11*a* and the first flange portion 11*b*. In the present embodiment, the frequency is changed by about 3 Hz when the phase angle is changed by 1°.

<Adjustment of Drum Flange 11>

The length L and the inlet radii r3 and r4 of the second flange portion 11*a* and the volumes V3 and V4 of the first flange portion 11*b* vary in component accuracy in manufacturing components. Therefore, in the second embodiment, the frequency for sound attenuation is made reliable by adjusting the phase of the second flange portion 11*a* and the first flange portion 11*b* at the time of assembling the components. To be specific, a pistonphone (a device that generates a sound having a predetermined frequency (not illustrated)) is pushed along the Helmholtz hole portion 11*a*2 of the second flange portion 11*a*, and sends a sound into the drum flange 11. A microphone (not illustrated) that can detect the sound is arranged outside the drum flange 11, and the microphone measures a level of the sound. The second flange portion 11*a* of the drum flange 11 is rotated while checking a measured value of the sound when the level of the sound exceeds a predetermined threshold, and the second flange portion 11*a* is stopped when the measured value becomes the threshold or less. In this state, the process is moved on to the next assembly process. In doing so, even if there is variation in the component accuracy and the like, the frequency for sound attenuation can be made reliable.

According to the present embodiment, a decrease in sounds caused by vibration of the photosensitive drum can be realized with limited cost, similarly to the above-described embodiments. Further, the decrease in sounds can be realized with the same photoreceptor for a plurality of image forming apparatuses having different frequencies of voltage to be applied to the photosensitive drum. Further, even if there is variation in the component accuracy and the like, the frequency for sound attenuation can be made reliable.

Other Embodiments

In the above-described embodiments, a configuration in which the image forming apparatus includes four photoreceptors has been exemplarily described. However, the number of the photoreceptors for use is not limited and may be appropriately set as needed.

Further, in the above-described embodiments, a printer has been exemplarily described as the image forming apparatus. However, the present invention is not limited to the embodiment. For example, another image forming apparatus such as a copying machine or a facsimile machine, or another image forming apparatus such as a multi-function peripheral having a combination of functions of the aforementioned machines may be employed. Similar effects can be obtained by applying the present invention to photoreceptors used in these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-196104, filed Oct. 4, 2016, which is hereby incorporated by reference herein in its entirety.

What is claimed is:

1. A photoreceptor comprising:

a cylindrical support on which a photosensitive layer is formed and to which a predetermined voltage is applicable; and a flange provided in an end portion of the support, the flange including a Helmholtz resonator including a cavity portion and a communication portion which allows the cavity portion and an outside to communicate with each other.

2. The photoreceptor according to claim 1, wherein the Helmholtz resonator has the cavity portion and the communication portion formed so as to generate a resonance phenomenon with a frequency of a voltage applied to the photoreceptor or a specific frequency of the photoreceptor to perform sound absorption.

3. The photoreceptor according to claim 1, wherein the flange includes a first flange portion including the cavity portion, and a second flange portion including the communication portion, and the first flange portion is provided in such a manner that a relative position is movable with respect to the second flange portion in a rotating direction of the photoreceptor.

4. The photoreceptor according to claim 1, wherein the cavity portion includes a first cavity portion and a second cavity portion, the communication portion includes a first communication portion allowing the first cavity portion and the outside to communicate with each other, and a second communication portion allowing the second cavity portion and the outside to communicate with each other, and the Helmholtz resonator is capable of absorbing sounds having different frequencies.

5. The photoreceptor according to claim 1, wherein the flange includes a first flange portion including a first cavity portion and a second cavity portion, and a second flange portion including a first communication portion and a second communication portion, and the first flange portion is provided in such a manner that a relative position is movable with respect to the second flange portion in a rotating direction of the photoreceptor.

6. The photoreceptor according to claim 5, wherein the first and second cavity portions included in the first flange portion are formed into a shape in which an area of an opening is changed in the rotating direction of the photoreceptor.

7. A photoreceptor comprising:

a cylindrical support on which a photosensitive layer is formed and to which a predetermined voltage is applicable; and a flange provided in an end portion of the support and including a Helmholtz resonator, wherein the flange includes a first flange portion and a second flange portion, and the first flange portion is provided in such a manner that a relative position is movable with respect to the second flange portion in a rotating direction of the photoreceptor, and a frequency absorbable by the Helmholtz resonator is able to be changed by changing relative positions of the first flange portion and the second flange portion.

8. The photoreceptor according to claim 7, wherein a cavity portion included in the first flange portion is formed into a shape in which an area of an opening is changed in the rotating direction of the photoreceptor.

9. An image forming apparatus comprising:

a photoreceptor;

a charge unit which charges the photoreceptor; and an exposure unit which exposes the photoreceptor charged by the charge unit to form an electrostatic latent image, wherein the photoreceptor includes:

a cylindrical support on which a photosensitive layer is formed and which is charged by the charge unit; and a flange provided in an end portion of the support, and the flange includes a Helmholtz resonator including a cavity portion and a communication portion allowing the cavity portion and an outside to communicate with each other.

10. An image forming apparatus comprising:

a photoreceptor;

a charge unit which charges the photoreceptor; and an exposure unit which exposes the photoreceptor charged by the charge unit to form an electrostatic latent image, wherein the photoreceptor includes:

a cylindrical support on which a photosensitive layer is formed and which is charged by the charge unit; and a flange provided in an end portion of the support and including a Helmholtz resonator, the flange includes a first flange portion and a second flange portion, and the first flange portion is provided in such a manner that a relative position is movable with respect to the second flange portion in a rotating direction of the photoreceptor, and a frequency absorbable by the Helmholtz resonator is able to be changed by changing relative positions of the first flange portion and the second flange portion.

* * * * *